US007066236B2

(12) United States Patent
Fujikawa

(10) Patent No.: US 7,066,236 B2
(45) Date of Patent: Jun. 27, 2006

(54) INJECTION DEVICE FOR LIGHT METAL INJECTION MOLDING MACHINE

(75) Inventor: Misao Fujikawa, Yokohama (JP)

(73) Assignee: Sodick Plustech Co., Ltd., Kanagawa (JP)

( * ) Notice: Subject to any disclaimer, the term of this patent is extended or adjusted under 35 U.S.C. 154(b) by 0 days.

(21) Appl. No.: 10/947,263

(22) Filed: Sep. 23, 2004

(65) Prior Publication Data

US 2005/0056978 A1 Mar. 17, 2005

(51) Int. Cl.
*B22D 17/04* (2006.01)

(52) U.S. Cl. ..... 164/312; 164/316

(58) Field of Classification Search ..... 164/312, 164/316, 113, 900
See application file for complete search history.

(56) References Cited

U.S. PATENT DOCUMENTS

| | | | | |
|---|---|---|---|---|
| 4,356,940 | A * | 11/1982 | Ansorge | 222/596 |
| 4,534,403 | A * | 8/1985 | Harvill | 164/316 |
| 5,983,976 | A * | 11/1999 | Kono | 164/113 |
| 6,152,159 | A * | 11/2000 | Miller et al. | 137/15.24 |
| 6,923,244 | B1 * | 8/2005 | Motegi et al. | 164/316 |
| 2003/0000676 | A1 * | 1/2003 | Motegi et al. | |

FOREIGN PATENT DOCUMENTS

| | | |
|---|---|---|
| EP | 1 275 451 A2 | 3/1997 |
| EP | 0 761 344 A2 | 1/2003 |
| JP | 05-212531 | 8/1993 |
| JP | 05-238765 | 9/1993 |
| JP | 05-254858 | 10/1993 |
| JP | 09-103859 | 4/1997 |
| JP | 09-108805 | 4/1997 |
| JP | 10-296417 | 11/1998 |
| JP | 3258617 | 12/2001 |
| JP | 2002-301559 | 10/2002 |
| JP | 2003-019552 | 2/2003 |

* cited by examiner

*Primary Examiner*—Kevin Kerns
*Assistant Examiner*—Ing-Hour Lin
(74) *Attorney, Agent, or Firm*—McDermott Will & Emery LLP

(57) ABSTRACT

An injection device for a light metal injection molding machine includes a melting device for melting light metal material into molten metal, plunger injection device for carrying out injection of molten metal using a plunger after the molten metal is metered into an injection cylinder from the melting device, connecting member including a connecting passage for connecting the melting device and the plunger injection device, and backflow prevention device for preventing backflow of molten metal by opening and closing the connecting passage.

3 Claims, 7 Drawing Sheets

INJECTION DEVICE FOR LIGHT METAL INJECTION MOLDING MACHINE

FIELD OF THE INVENTION

The present invention relates to an injection device for a light metal injection molding machine for melting a light metal material such as magnesium, aluminum or zinc and injecting this molten metal into a mold to perform molding, and, in particular, relates to an injection device for a light metal injection molding machine for melting a light metal material inside a melting cylinder of a melting device, supplying and metering the molten metal to an injection cylinder of a plunger injection device provided beside the melting device, and injecting a measured amount of molten metal using a plunger to perform molding.

BACKGROUND OF THE INVENTION

Conventionally, molding of light metal alloys has been carried out using a die casting method exemplified by a hot chamber method and a cold chamber method. In particular, magnesium alloy molding is also carried out using thixotropic molding as well as the above-described die casting methods.

Die casting methods involve supplying molten light metal material that has been melted in a furnace beforehand to the inside of an injection cylinder of an injection unit, and injecting the molten metal into a mold using a plunger. With this type of method, high temperature molten metal is supplied stably to the injection cylinder. In particular, with the hot chamber method, since the injection cylinder is arranged inside the furnace, high temperature molten metal is supplied to the mold in a fast cycle time. Also, with the cold chamber method, since the injection cylinder is arranged separately from the furnace, it is easy to carry out maintenance of the injection unit. On the other hand, with thixotropic molding, small pellet-shaped magnesium material is melted into a semi-molten state by shearing heat due to rotation of a screw and heat from a heating system, and then injected. The injection device for this molding is constituted by one of two types of units, as described in the following. One type of unit is the unit disclosed, for example, in Japanese Patent No. 3258617 provided with a melting unit for melting light metal material in a semi-molten state using a screw inside an extrusion cylinder, and an injection unit for injecting molten metal supplied from the melting unit to the inside of an injection cylinder, with connection between the extrusion cylinder and the injection cylinder being made using a connecting member. Another type of unit is a unit having basically the same structure as an in-line screw type injection machine, for carrying out melting and injection with a single cylinder having an in-line screw built-in. The latter structure is fairly general, and so disclosure of prior art documents, such as patent documents, will be omitted. In any event, the injection molding machine using these thixotropic molding methods has the advantage that there is no need to provide a large capacity furnace required for a die casting method.

However, with the above-described molding methods, there is a problem with the following improvements. First of all, with the die casting method, since a large capacity furnace is used the unit accompanies increase in scale, and since a lot of molten metal is kept at a high temperature the unit results in increased running costs. Also, because it takes a long time to raise the temperature of the furnace, maintenance of the furnace takes at least a day. In addition, particularly in the case of using magnesium alloy, it is extremely easy for magnesium to be oxidized and to catch fire, which means that oxidization prevention measures for the molten metal and adequate fire prevention measures are required. It is therefore necessary to inject a lot of non-burning flux or inert gas into the furnace. On top of this, since sludge having a main component of magnesium oxide is generated even if such counter measures are adopted, it is necessary to carry out sludge clean-up operations regularly. This sludge also causes wear. On the other hand, with the thixotropic molding, melting of the pellet-shaped material is carried out by rotating a screw, which means that it is not always easy to consistently melt the material to a desired semi-molten state. In particular, with an in-line screw type injection molding machine, since metering is carried out while causing the screw to retreat, skill is required in adjusting molding conditions. It is also easy for a screw and check ring to become worn. Also, since the molding material is a pellet-shaped material causing an increase in the surface area, it is easy for oxidation to occur. As such, it is necessary to consider the handling of the material.

In view of the above drawbacks, alternative injection devices have been proposed. One example is the injection device disclosed in Japanese Patent Laid-Open No. Hei. 05-212531. This injection device is an injection cylinder which comprises a metal mold side (front side) high temperature cylinder section, a rear side low temperature cylinder section, and a heat insulating cylinder section between them. With this injection device, molding material formed into cylindrical bars in advance is fitted into the injection cylinder and melted inside the high temperature cylinder section, and the molten metal is extruded and injected using not-yet melted molding material. Since the molding material itself injects without using a conventional plunger, in the present specification the molding material with this molding method will be called a self-consumption plunger. Since this type of injection device is not provided with a furnace, the volume of molten metal is reduced as a result of simplifying the vicinity of the injection device, which means that effective melting is likely to be made possible. Also, since this type of injection device is not provided with a plunger, it is possible to reduce wear of the injection cylinder and to carry out maintenance in a short time.

Further, similar techniques are also subject of patent applications by the same applicant (for example, Japanese Patent Laid-Open No. Hei. 05-238765 and Japanese Patent Laid-Open No. Hei. 05-254858). These documents disclose injection devices for glass molding, but because they use the self consumption plunger they are similar techniques. Specifically, Japanese Patent Laid-Open No. Hei. 05-238765 discloses a seizing-up prevention technique, in which pluralities of grooves or spiral grooves are formed in advance in a cylinder side, and molding material is cooled by circulation of a cooling medium in these grooves. Also, Japanese Patent Laid-Open No. Hei. 05-254858 discloses the seizing up prevention technique, where pluralities of grooves or spiral grooves are formed in a molding material (self consumption plunger) side; and are absorbing diameter expansion and deformation of softened molding material. Since glass is supplied in a high viscosity softened state in a comparatively wide temperature range and molten metal is not directly embedded in the grooves, the grooves can be used effectively in preventing seizing up of the glass material.

However, Japanese Patent Laid-Open No. Hei. 05-212531 described above does not disclose a technique that is practicable with respect to the length of molding material, structure of a injection device and a molding operation itself. For example, Japanese Patent Laid-Open No. Hei. 05-212531 discloses nothing about solving that at the time of injection, low viscosity molten metal flows backward at high pressure in a gap between the injection cylinder and the self consumption plunger, and as a result is solidified, rendering movement of the plunger impossible. This phenomenon often arises when the injection device is injecting light metal material and is more pronounced when carrying out injection at high speed and high pressure. This is because solidified matter of the molten metal is often destroyed, re-formed, and then grows to be the stronger solidified matter at time of injection operation.

No method for solving this type of phenomenon is disclosed in either of the above disclosed patent Japanese Patent Laid-Open No. Hei. 05-238765 or Japanese Patent Laid-Open No. Hei. 05-254858. The reason for this is that in the case of using these molding devices in molding of light metal material, since molten metal quickly infiltrates into the grooves and is solidified over a wide range, the grooves do not function as cooling grooves or as deformation absorption grooves. More specifically, this is because the molten metal solidifies accompanying immediate entry into the grooves since light metal melts or solidifies quickly due to the small specific heat and latent heat and high thermal conductivity inherent to light metal, since the temperature range of material exhibiting a softened state is narrower than that of glass, and since molten metal exhibits extremely low-viscosity fluidity. As a result, the above-described operational effect of the grooves is not demonstrated in cases such as glass molding due to filling of the solidified matter. Since these patent documents disclose techniques for preventing seizing up of glass material in a glass molding injection device, naturally they are relevant.

The object of the present invention is to provide an injection device capable of efficiently supplying light metal material to a melting unit, and also capable of more reliably, efficiently and stably supplying molten metal to a plunger injection device, by proposing a characteristic light metal material supply method and an injection device including a characteristic melting unit for effectively handling this supply method. A further object of the present invention is to provide a melting device and a plunger injection device capable of reducing wear and suppressing backward flow of molten metal from a melting cylinder during metering or from an injection cylinder during injection. The other operational effects achieved using such a structure will be described together with a description of embodiments.

SUMMARY OF THE INVENTION

An injection device for a light metal injection molding machine of the present invention is an injection device for a light metal injection molding machine which includes a melting device for melting lightmetal material into molten metal, a plunger injection device for carrying out injection of molten metal using a plunger after the molten metal is metered into an injection cylinder from the melting device, a connecting member including a connecting passage for connecting the melting device and the plunger injection device, and a backflow prevention device for preventing backflow of molten metal by opening and closing the connecting passage. According to the invention, the light metal material is supplied in the form of cylindrical rod-shaped billets equivalent to shot volume of pluralities of shots. The melting device of the present invention further comprises a melting cylinder for heating and melting a plurality of the billets supplied from a rear end to generate molten metal equivalent to volume of pluralities of shots at a front side, where the billets are subjected to preliminary heating at the base end of the melting cylinder in a state where softening is prevented, and are strongly heated while passing from the middle part to the forward end to rapidly melt at the forward end, a billet supply device positioned at a rear side of the melting cylinder, for supplying the billets one at a time at the time of material supply in such a manner that they can be inserted from the back of the melting cylinder, and a billet inserting device positioned behind the billet supply device which contains a pusher for forcing molten metal for one shot volume into the injection cylinder using the billet when metering, or for inserting the billet into the melting cylinder at the time of material supply.

By virtue of this structure, with the injection device for a light metal injection molding machine of the present invention, by carrying out melting of the billets in the melting device and carrying out metering between the melting device and the plunger injection device, it is possible to efficiently supply molding material in a billet form that is easy to handle, and pressure of molten metal does not become excessive at the time of metering, which means that it is possible to meter in a stable manner and it is easy to prevent backward flow of molten metal. Also, the injection device of the present invention does not require melting of a large amount of metal during a molding operation, which means that efficient melting of material is achieved, and operation and handling of an injection device are made easy by miniaturization and simplification of the melting device.

Also, most of the cylinder bore, except for a base end, of the melting cylinder of the present invention described above, can be formed at such a size as to prevent backward flow of molten metal by contacting a side surface of a tip end of the billets when the softened billets move and the side surface of the tip end of the billets increases in diameter at the time of metering.

Using this type of structure, since the tip section of the softened billet that has expanded in diameter comes into contact with the cylinder bore of the melting cylinder of the melting device in a uniform and appropriately softened state, a gap between the cylinder bore and the billet is sealed in a stable manner, and friction is reduced. It is also possible to suppress wear of the melting cylinder and the pusher. The melting cylinder can be formed in a simply shaped inner diameter.

Also, most of a cylinder bore, except for a base end, of the melting cylinder of the present invention described above, can be preferably formed with a dimensional relationship causing a gap with a side surface that is enlarged in diameter as the tip of a softened billet advances; and at a base end side of the melting cylinder can be provided a cooling member for cooling the base end side of the billet to such an extent that there is no deformation due to pressing force at the time of metering, and a cooling sleeve, being of a small volume member and being positioned between the melting cylinder and the cooling member, for cooling molten metal, with the cooling sleeve having an annular groove forming a seal member of a solid material around the billet, solidified from the molten metal to such an extent as to prevent backward flow of the molten metal.

Using this type of structure, it is possible to suppress wear of the melting cylinder and the pusher as well as to reliably form a seal between the melting cylinder of the melting device and the billet without an accompanying increase in frictional resistance using the seal member. This type of structure can achieve this operational effect even if adopted in a particularly large injection device or a high cycle rate molding machine.

The above described injection device for a light metal injection molding machine of the present invention can also have a structure where the front side of the melting cylinder is closed off by an end plug which has an introduction hole connecting from an upper side of the cylinder bore of the melting cylinder to the connecting passage.

With this type of structure, when operation starts, air or inert gas remaining inside the melting cylinder can be purged quickly, and there is also no unstable outflow of molten metal inside the melting cylinder to the injection cylinder, that causes no suspension of initial melting of the light metal material.

In an alternative embodiment of the present invention, an injection device for a light metal injection molding machine has a structure where most of the plunger is formed in a simple cylindrical shape, a small diameter projecting section is provided on the base end of the injection cylinder controlled to a lower temperature than the injection cylinder, an inner hole of a base end of the small diameter projection section is formed having an inner diameter such that there is almost no gap formed with the plunger, an annular groove is formed in the inner hole of the small diameter projecting section, most of a cylinder bore, except for a base end side, of the injection cylinder is formed with an inner diameter having a gap with respect to the plunger, and as a result a solidified seal member of the molten metal is generated in the annular groove to an extent that prevents backward flow of the molten metal.

Using this type of structure, molten metal is reliably sealed by the seal member even without direct contact of the plunger with the injection cylinder, and it is possible to carry out injection without causing a significant increase in frictional resistance between the plunger and the injection cylinder. Wear of the plunger and the injection cylinder is therefore significantly decreased and so maintenance and replacement operations are reduced.

The injection device for a light metal injection molding machine of the present invention may also have a structure where the plunger includes a head section fitted in a state where a miniscule gap is formed with respect to the injection cylinder and a shaft section of smaller diameter than the head section. The head section includes pluralities of annular grooves around the head section and plunger cooling means in the center and, as a result, a solidified seal member of the molten metal is generated in the annular groove to an extent that prevents backward flow of the molten metal.

Using the above structure, the seal member formed in the annular grooves of the plunger reliably seals the molten metal at the time of injection, and there is no contact between the injection cylinder and the plunger. Frictional resistance between the plunger and the injection cylinder is therefore reduced, and wear of the plunger and the injection cylinder is also significantly reduced, as are maintenance and replacement operations.

The above described injection device for a light metal injection molding machine of the present invention can also have a structure where the backflow prevention device includes a valve seat formed at a connecting passage inlet on a surface of the inner hole of the injection cylinder, a backflow prevention valve rod for opening and closing the connecting passage from an inner side of the injection cylinder by moving at the valve seat, and a valve rod drive unit for driving the backflow prevention valve rod forward and backward from an outer side of the injection cylinder.

Using the above structure, naturally backward flow prevention for the connecting passage is accurately controlled, and even for magnesium alloy, which easily solidifies, molten metal is not caused to solidify around the backflow prevention valve rod.

The injection device for a light metal injection molding machine of the present invention may have a structure where a nozzle hole running from the injection cylinder of the injection device to an injection nozzle to be formed at an upper position is offset with respect to the cylinder bore.

Using the above structure, it is naturally possible to rapidly purge air and gas remaining inside the injection cylinder at the time of commencing operation. As such, a problem of unwanted discharge of molten metal from the tip of the injection nozzle during injection is remedied.

With the above described injection device for a light metal injection molding machine of the present invention, it is also possible for the melting device to be arranged above the plunger injection device, for the front side of the melting cylinder to be closed off by an end plug, with the end plug being provided with an introduction hole which connects the cylinder bore of the melting cylinder to the connecting passage and opens at an upper part of the cylinder bore, for a nozzle hole connecting from the injection cylinder to the injection nozzle to be formed at an upper position offset with respect to the cylinder bore of the injection cylinder, and for the injection cylinder and the melting cylinder at least to be arranged at an inclined attitude with respective forward side at a high position and base end side at a lower position.

Using the above structure, it is naturally possible to rapidly purge air and gas remaining inside the melting cylinder and the injection cylinder at the time of commencing operation. As such, it is possible to remedy a problem where molten metal flows out in an unstable manner from the melting cylinder to the injection cylinder at the time of commencing operation, and a problem of unwanted discharge of molten metal from the tip of the injection nozzle in the interval of injections is also remedied.

DETAILED DESCRIPTION OF THE PREFERRED EMBODIMENTS

Figure 1:
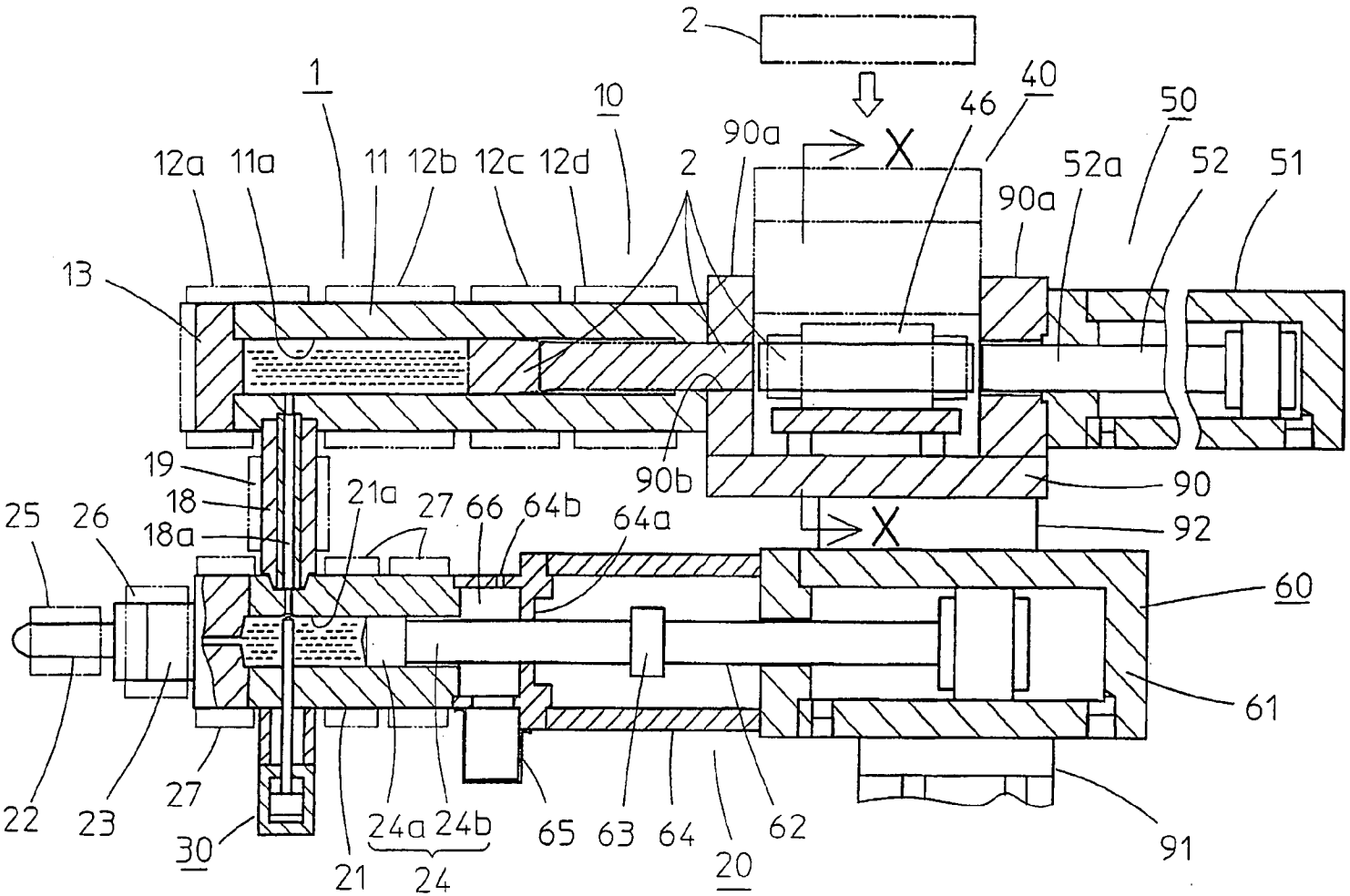
FIG. 1 is a side elevation cross-sectional view showing the outline structure of an injection device for a light metal injection molding machine of the present invention.

Initially, light metal material supplied to the injection device 1 will be described. As shown in FIG. 1, light metal material is formed in short rod-shapes, such as by cutting cylindrical rod to a specified length (hereafter called billets), and the periphery and cut surface of the billets are smoothed. Reference numeral 2 is a billet, and the outer diameter of this billet is formed slightly smaller than the inner diameter of a base end side (the right side in the drawing) of a cylinder bore 11*a* of the melting cylinder 11 that will be described later. This is so that the billet 2 will not interfere with the base end side of the cylinder bore 11*a* and will not become impossible to fit in bore 11 when it is heated and expands due to thermal expansion of the metal. The length of the billet 2 is formed to a length including an injection volume of from about 10 shots to a few tens of shots of the injection volume injected in one shot, and taking into consideration the handling of the billet, is formed, for example at about from 300 mm to 400 mm. Since the light metal material is supplied in this type of billet form, storage of the billets and materials handling is made easy. Therefore, particularly in the case where the billets 2 are of a magnesium material, since the surface area with respect to the volume is small, the billets have the advantage that they are more difficult to oxidize than palletized metal used in thixotropic molding. The above mentioned injection volume injected in one shot is the sum of the volume of an item formed with one shot, volume of a spool, runner, and volume of expected thermal shrinkage involved in that.

The injection device 1 of the light metal injection molding machine of the present invention having light metal material supplied in the form of billets, as described above, is configured as described in the following. As shown in FIG. 1, this injection device 1 includes a melting device 10, a plunger injection device 20, a connecting member 18 connecting the melting device 10 and the plunger injection device 20, and a backflow prevention device 30 for preventing backflow of molten metal from the plunger injection device 20 to the melting device 10 at the time of injection.

The melting device 10 comprises a melting cylinder 11, a billet supply device 40 and a billet inserting device 50. The melting cylinder 11 is a long cylinder formed having a length capable of holding pluralities of billets 2 that are inserted sequentially from a base end of the melting cylinder 11, and as will be described later most of the cylinder bore 11*a*, except for the vicinity of the base end, is formed with a slightly larger diameter than a billet 2, and the forward end of the cylinder bore 11*a* is blocked by an end plug 13. The base end of the melting cylinder 11 is fixed to a central frame member 90 housing the billet supply device 40. The central frame member 90 comprises four side plates of a rectangle enclosed in every direction and a single bottom plate, with the melting cylinder 11 being connected to one of a pair of opposed side plates 90*a* and the billet inserting device 50 being connected to the other side plate 90*a*. Through holes 90*b* slightly larger than the outer diameter of a billet 2 are formed in these two side plates 90*a*. In this way, the melting cylinder 11, billet supply device 40 and billet inserting device 50 are arranged in series on a single line. As will be described later, billets 2 are then supplied to the rear of the melting cylinder 11 one at a time for every plurality of shots, and are inserted into the melting cylinder 11 using a plunger 52*a* of the billet inserting device 50. In this manner, with the present invention, light metal material is supplied to the melting device 10 in billet form and melted. The melting cylinder 11, billet supply device 40 and billet inserting device 50 will be described in more detail later.

The plunger injection device 20 comprises an injection cylinder 21, an injection nozzle 22, a plunger 24 and a plunger drive device 60. The injection cylinder 21 has a cylinder bore 21*a* for retaining metered molten metal, and the injection nozzle 22 contacting a mold, not shown in the drawing, is attached to a forward end of the cylinder bore 21*a* by means of a nozzle adapter 23. The plunger 24 is connected at a base end (root) to a piston rod 62 of the plunger drive device 60, and is subjected to movement control in a longitudinal direction inside the injection cylinder 21. This type of plunger injection device 20 is mounted on a slide base 91 that moves in a longitudinal direction on a machine base frame (not shown), and the entire injection device 1 moves so as to be joined or separated from a mold clamping unit, not shown. The injection cylinder 21, injection nozzle 22, plunger 24 and plunger drive device 60 will be described in more detail later.

The vicinity of a forward end of the melting cylinder 11 and the vicinity of a forward end of the injection cylinder 21 are connected using the connecting member 18, while the base ends of the two cylinders 11 and 21 are rigidly joined by means of a connecting base member 92 between the central frame member 90 and a hydraulic cylinder 61 of the plunger drive device 60. A connecting passage 18*a* is formed within the connecting member 18, and this connecting passage 18*a* connects the cylinder bore 11*a* of the melting cylinder 11 with the cylinder bore 21*a* of the injection cylinder 21. The vicinity of the forward end of the melting cylinder 11 and the vicinity of the forward end of the injection cylinder 21 are fixed by means of the connecting member 18 by drawing them together using a bolt, not shown. Both ends of the connecting member 18 are then fixed by fitting into the outer peripheries of the melting cylinder 11 and the injection cylinder 21. In particular, the connecting passage 18*a* contains a fine diameter pipe, with both end surfaces being pressed against the melting cylinder 11 and the injection cylinder 21.

The connecting passage 18*a* is opened at the time of commencing metering operations, and closed immediately before an injection operation, by the backflow prevention device 30. Therefore, the backflow prevention device 30 can be a device known from the related art as long as it performs such an opening and closing operation. A preferred backflow prevention device 30 will be described in detail later.

In this type of injection device 1, billets 2 advancing during metering are sequentially melted from the forward end inside the melting cylinder 11, and resultant molten metal is held in a molten state inside the injection cylinder 21 and the connecting member 18. These cylinders 11 and 21 and the connecting member 18 are then subjected to heating control to a specified temperature using a wrapped band heater and so on.

For example, as shown in FIG. 1 four heaters 12*a*, 12*b*, 12*c* and 12*d* are wrapped around the melting cylinder 11. The two heaters 12*a* and 12*b* at the forward end are set to the melting temperature of the billets 2, the heater 12*c* is set to a temperature that is slightly lower than this melting temperature, and the heater 12*d* at the base end is set to a temperature even lower than the melting temperature. In particular, the base end heater 12*d* is set to a low temperature that suppresses softening of a billet 2 positioned at the base end of the melting cylinder 11 to an extent that it is not deformed at the time of advancing (metering). For example, in the case of a billet 2 of magnesium alloy, the forward end heaters 12*a* and 12*b* are appropriately adjusted to about 650°

C., the heater 12*c* to about 600° C., and the base end heater 12*d* to 350–400° C. This is because magnesium alloy starts to soften once it is heated to about 350° C., and when it reaches 650° C. it melts completely. However, the temperature of the heater 12*d* is slightly different depending on the specific embodiment, and is adjusted to different temperatures in embodiments that will be described later. The side plates 90*a* of the central frame member 90 are normally not heated.

Also, heaters 25, 26 and 27 are wrapped around the injection nozzle 22, nozzle adapter 23 and injection cylinder 21, and a heater 19 is wrapped around the connecting member 18. In the case of a magnesium alloy billet 2, these heaters are heat controlled to a temperature of about 650° C. and molten metal inside the connecting member 18 and the injection cylinder 21 is kept in a molten state. In particular, the controlled temperature of the heater 25 can also be adjusted to conform with a molding cycle time (injection interval). This is to prevent leakage of molten metal from the injection nozzle 22 using a cold plug created inside the nozzle, so as to open and close the injection nozzle 22 in conformance with the molding cycle.

In this manner, a billet 2 is subjected to preliminary heating at the base end of the melting cylinder 11 in a state where softening is prevented, and is strongly heated while passing from the middle part to the forward end to rapidly melt at the forward end. The volume of molten metal is controlled to be several shots of injection volume. With this type of melting device 10, since only the minimum amount of material is melted, heat energy is reduced, which is efficient. Also, the melting device 10 does not require a large volume, as there is no furnace, which means that the device is made small and simple. Further, time required to raise the temperature for melting or the time required to cool down to solidification temperature are reduced, making it possible to minimize wasteful waiting time in maintenance and inspection operations.

Next, the essential structure of the injection device 1 of this invention will be described in more detail. However, preferred embodiments relating to the melting cylinder 11 and the injection cylinder 21, which are main structural components of the injection device 1, will be described together in detail later.

Figure 2:
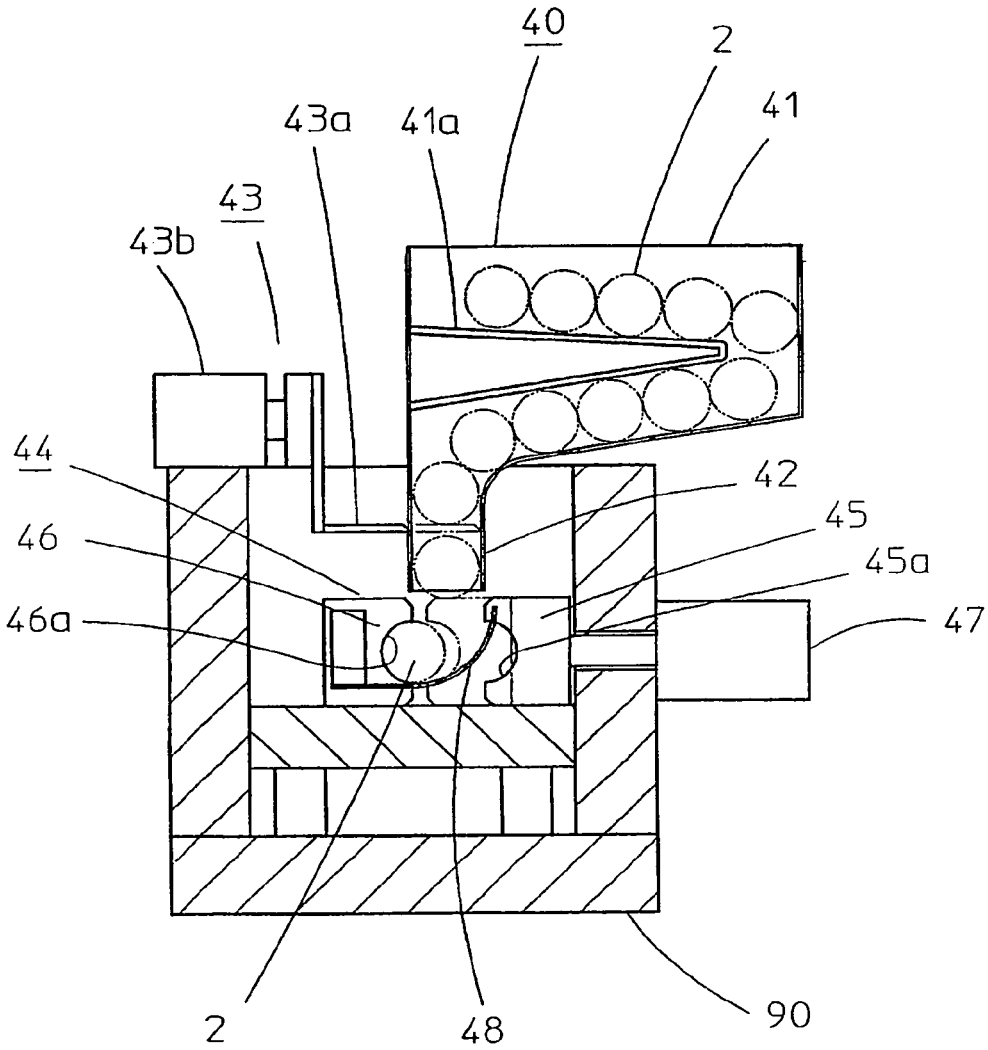
FIG. 2 is a side cross sectional view of a billet supply device of the injection device of the present invention, and is a cross-sectional view in the direction of arrows X—X in FIG. 1.

The billet supply device 40 is a device for storing pluralities of billets 2, and supplying billets 2 one at a time to a concentric position closest to the rear end of the melting cylinder 11 so as to be inserted into the melting cylinder 11. Therefore, as shown, for example in the cross section of FIG. 2, the billet supply device 40 is comprised of a hopper 41 loaded with pluralities of billets 2 in a lined up state, a chute 42 for causing the billets to drop sequentially in the aligned state, a shutter device 43 for temporarily catching billets 2 and allowing them to drop one at a time, and a holder 44 for holding the billets concentrically with an axial center of the melting cylinder 11. A dividing plate 41*a* forming a reflexed guide passage is arranged inside the hopper 41, so that the billets 2 drop without building up. The shutter device 43 constitutes an upper and lower two stage shutter with a shutter plate 43*a* and a holding member 45 of an opening and closing side of the holder 44, and allows billets 2 to drop one at a time by alternate opening and closing operation of the shutter plate 43*a* and the holding member 45. Reference numeral 43*b* is a fluid cylinder such as an air cylinder for moving the shutter plate 43*a* backwards and forwards. The holder 44 comprises one set of holding members 45, 46 for holding the billet 2 by gripping from the left and right leaving a miniscule gap, a fluid cylinder 47 such as an air cylinder for opening and closing one holding member 45, and a guide member 48 provided below the chute 42 for receiving a billet 2 on a curved guide surface and guiding that billet to the holding member 46 side. Substantially semicircular arc-shaped indents 45*a* and 46*a* having a diameter slightly larger than the outer diameter of the billets are formed on mutually opposite inner side surfaces of the holding members 45 and 46, formed so that when the holding member 45 is closed, the centers of these indents 45*a* and 46*a* are substantially aligned with the center of the cylinder bore 11*a*.

Using this type of structure, the billets 2 supplied from the hopper 41 are held concentrically with the center of the cylinder bore 11*a*. Naturally, although not shown in the drawing, the billet supply device 40 can also have a structure comprising two shutters for allowing the billets 2 to drop down from the hopper one at a time and a groove shaped guiding member for holding the billets 2 concentrically with the center of the cylinder bore 11*a*, instead of the shutter device 43 and the holding member 45.

The billet inserting device 50 can also be any type of device as long as it is a device for inserting billets 2 into the melting cylinder 11 at the time of supplying billets 2. For example, as shown in FIG. 1, the billet inserting device 50 has a structure comprising a hydraulic cylinder 51, a piston rod 52 subjected to controlled movement backwards and forwards by the hydraulic cylinder 51, and a pusher 52*a* integrally formed on a tip end of this piston rod. The pusher 52*a* has a tip section (left end section in the drawing) formed slightly thinner than a billet, and when penetrating a tiny amount into the melting cylinder 11 it enters without touching the melting cylinder 11. Wear therefore does not arise between the pusher 52*a* and the melting cylinder 11. The maximum movement stroke of the pusher 52*a* constitutes a length slightly exceeding the overall length of a billet 2. The position of the pusher 52*a* is detected, for example, by a position detection device such as a linear scale, not shown in the drawing, and this detected position is fed back to a control device, not shown. This type of billet inserting device 50 is not limited to a drive unit for a hydraulic cylinder drive, and can also be a known electrical drive unit for converting rotational movement of a servo motor to linear movement by means of a ball screw or the like, to drive the pusher 52*a*.

The billet inserting device 50 constructed in this way causes the pusher 52*a* to move backwards by a distance greater than the overall length of the billet 2 at the time of supplying billets, to ensure a space for billet 2 supply, and next the pusher 52*a* is advanced to insert the supplied billet 2 into the melting cylinder 11. Also, the billet inserting device 50 causes successive advance of the pusher 52*a* at the time of metering, and in one advance molten metal corresponding to an injection volume for one shot is fed to the injection cylinder 21 and metered.

The plunger 24 can be a conventionally known type. In this case, the plunger 24 is provided with a head section 24*a* having a slightly smaller diameter than the inner diameter of the injection cylinder 21 and a shaft section 24*b* having a diameter slightly smaller than the head section 24*a*. The head section 24*a* has a piston ring, not shown, provided on its periphery. When the plunger 24 has the same structure as that known in the related art in this way, there is wear between the plunger 24 and the injection cylinder 21, but when performance is as satisfactory as in the related art, it is sufficient to be adopted for practical use. A preferred embodiment will be described later, as a structure combined with the injection cylinder.

As shown in FIG. 1, the plunger drive device 60 comprises, for example, a hydraulic cylinder 61, a piston rod 62 subjected to movement control in the longitudinal direction by the hydraulic cylinder 61, and a coupling 63 for joining the piston rod 62 and the plunger 24. The plunger 24 is fitted inside the injection cylinder 21 and is driven to move longitudinally by the hydraulic cylinder 61. The position of the plunger 24 is detected using a position detection device, such as a linear scale (not shown), for example, and this detected position is fed back to a controller, not shown, to control position of the plunger 24. The maximum stroke along which the plunger 24 can move is obviously designed in advance in accordance with maximum injection volume of the injection device 1. This type of plunger drive device 60 is not limited to a hydraulic cylinder drive-type drive unit, and it is also possible to have a known electrical drive unit for converting rotational movement of a servo motor to linear movement by means of a ball screw or the like, to drive the plunger 24.

This type of plunger drive device 60 controls a reverse operation and advancing operation of the plunger 24 at the time of metering and at the time of injection. Specifically, when metering, back pressure permitting reverse movement of the plunger 24 is controlled in accordance with control of pressure for pressing the pusher 52*a* of the billet inserting device 50, so that pressure increase of the molten metal inside the melting cylinder 11 is suppressed and pressure of the molten metal inside the injection cylinder 21, that is, back pressure at the time of metering, is appropriately controlled. At this time, detection of the reverse position of the plunger 24 as a position for metering is the same as that carried out in the related art. Control of the injection speed and injection pressure at the time of injection is also the same as that in the related art. Also, the plunger drive device 60 carries out the suck back operation, where the plunger 24 is caused to retreat a specified amount, which is known in the related art. Since the plunger injection device is isolated from the melting device by means of a backflow prevention unit, this type of suck back operation can be made accurate.

The base end of the injection cylinder 21 is fixed in front of the plunger drive device 60 by means of a connection member 64. A connection member 64 illustrated as one embodiment is a cylindrical member movably housing a rear part of the plunger 24 and a coupling 63, with a barrier wall 64*a* for fitting at a position close to the front so that there is almost no gap with the plunger 24, and a space 66 is provided between the injection cylinder 21 and the barrier wall 64*a*. A collection pan 65 is detachably provided below the space 66, at a lower side of the connection member 64. Using this type of structure, even if molten metal crosses over the head section 24*a* of the plunger 24 and leaks out, the molten metal does not fly out further than this space 66, and is collected in the collection pan 65.

In this case, a pour hole 64*b* for pouring in inert gas can be provided at an upper side of the connection member 64, and inert gas can be poured in to the space 66. Using this pour hole 64*b*, air inside the injection cylinder 21 is purged immediately before starting operation. This type of purging is particularly useful for preventing oxidization in the case of magnesium molding. The amount of supplied inert gas is only small, because it is only supplied to the space 66 and a tiny gap between the injection cylinder 21 and the plunger 24. Naturally, there is no infiltration of this inert gas into the molten metal from the rear of the cylinder. Accordingly, there will be no problem whatsoever even if supply of gas is stopped after starting molding.

For simplicity, it is also possible to adopt conventionally known valves in the backflow prevention device 30. As these valves are quite well known they are not shown in the drawings, but, for example, check valve or rotary valve is adopted. The former is valve including a valve body for blocking a connecting passage by moving in both forward and reverse direction together with flow of molten metal, and mounted on a valve seat at the time of injection. The latter is rotating valve provided with a duct opening up or blocking off the connecting passage 18*a* by rotating inside the connecting passage 18*a*. In particular, check valve does not have accurate timing for preventing backward flow at the time of injection, and so are adopted in injection molding machines that do not require precise molding. A preferred backflow prevention device 30 will be described in more detail later.

Figure 3:
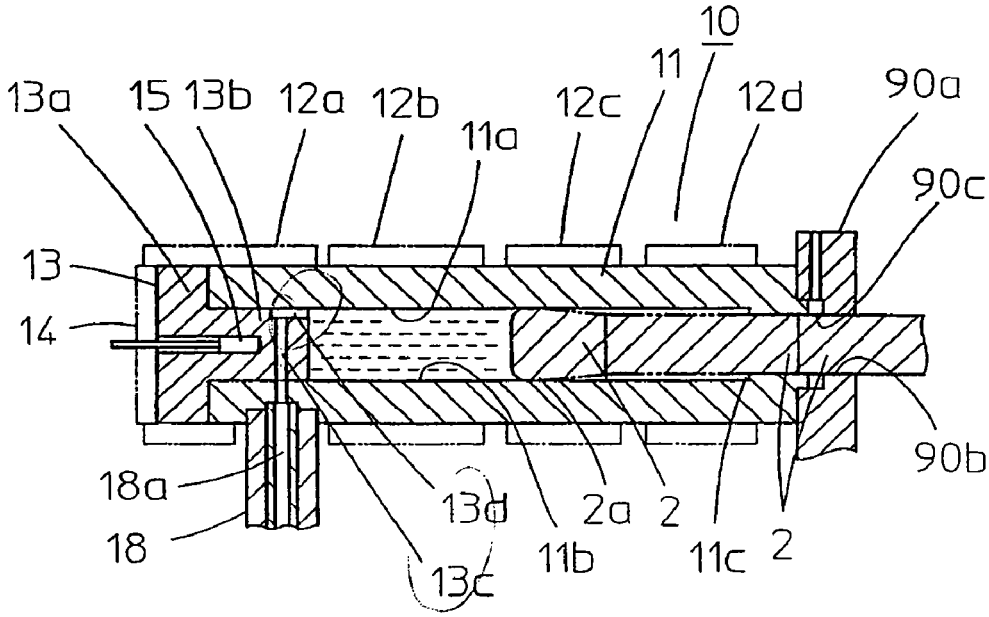
FIG. 3 is a side elevation showing a cross-sectional view of a melting cylinder of the present invention.
Figure 4:
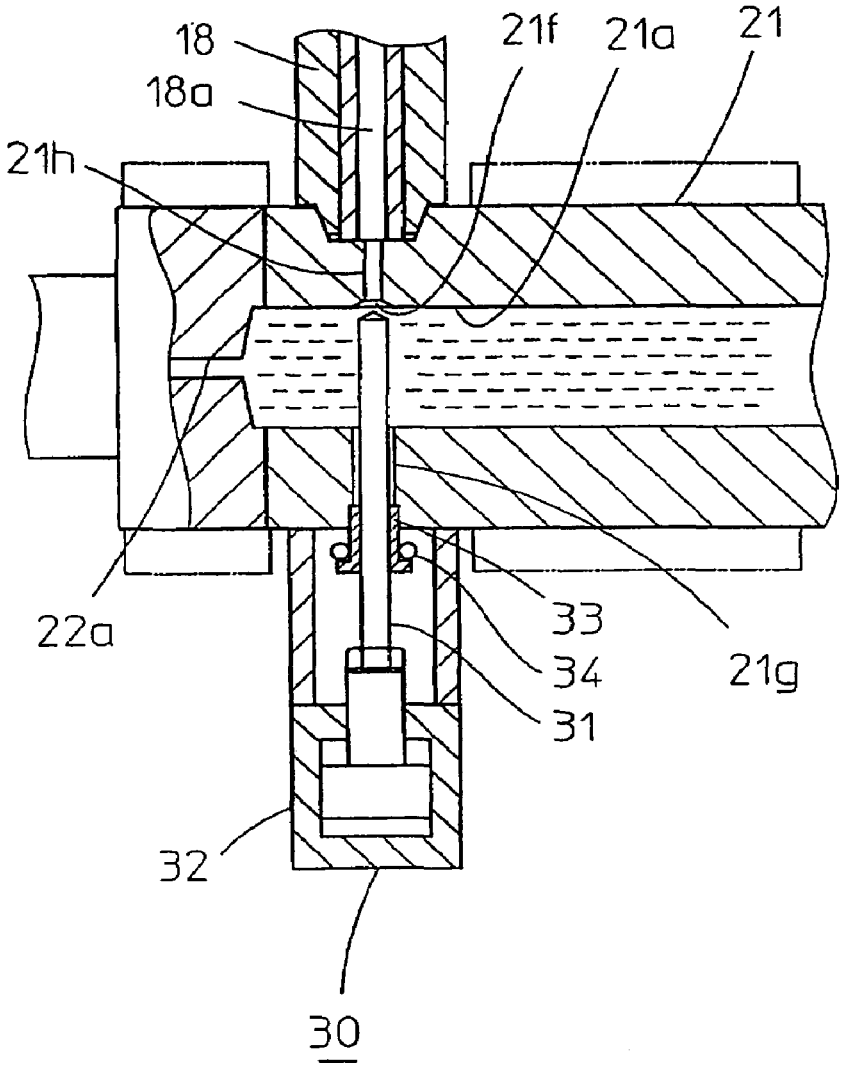
FIG. 4 is a side cross-sectional view showing one of embodiments of backflow prevention devices of the present invention.
Figure 5:
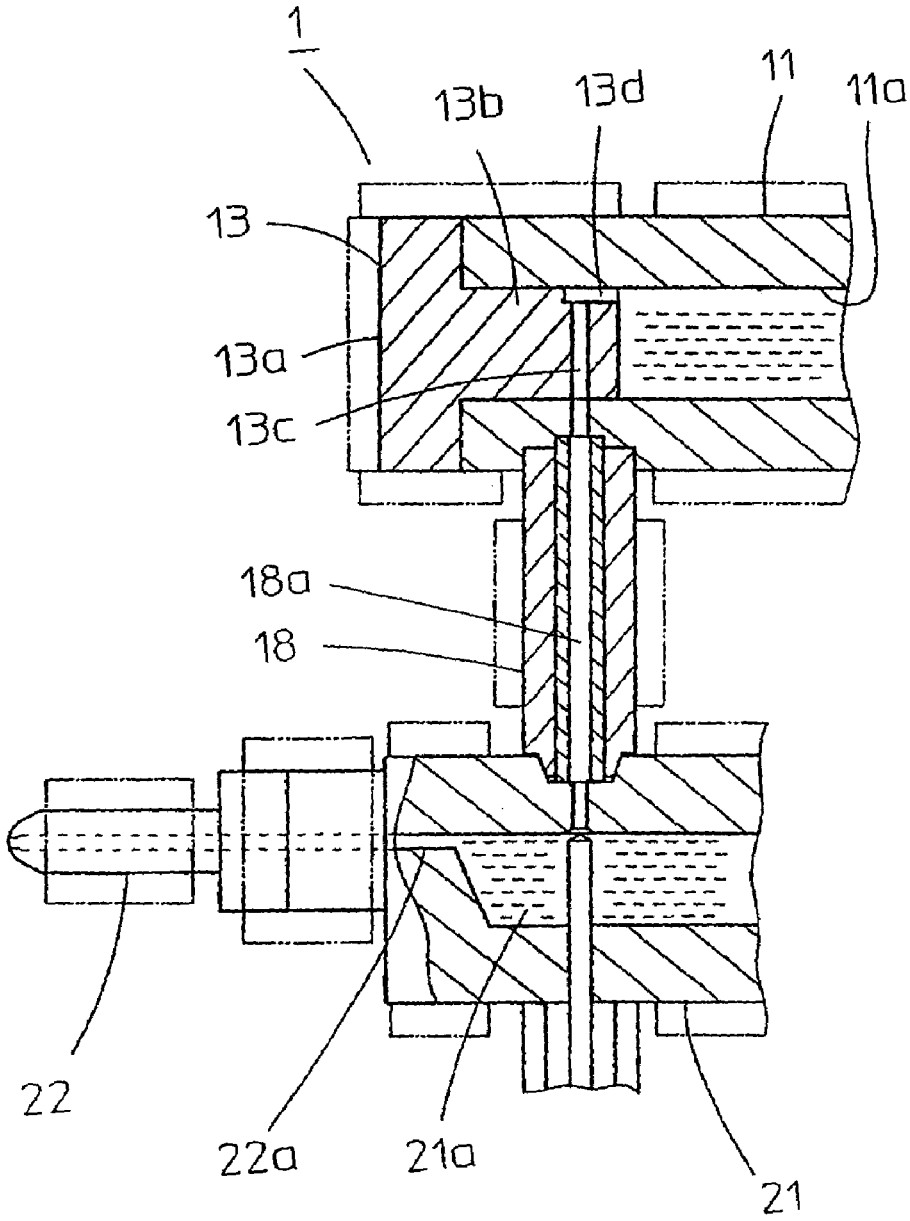
FIG. 5 is a side cross-sectional view of another embodiment of the vicinity of a forward end section of the injection cylinder and melting cylinder of the present invention.

The injection device 1 can more preferably have a structure as described in the following. FIG. 3 is a side cross sectional drawing showing one embodiment of a melting cylinder, FIG. 4 is a side cross section showing a preferred embodiment of a backflow prevention device, and FIG. 5 is a side cross section showing another embodiment of the vicinity of a forward end section of the injection cylinder and melting cylinder.

The end cap 13 for blocking off the forward end of the melting cylinder 11 is provided with a flange section 13*a* and a plug member 13*b*, as shown in FIG. 3. The plug member 13*b* is formed in a length that passes a position of contact with the connecting member 18, and has introduction holes 13*c* and 13*d* connecting to the connecting passage 18*a* of the connecting member 18 and the cylinder bore 11*a* of the melting cylinder 11. In particular, the introduction hole 13*d* connecting to the cylinder bore 11*a* of the melting cylinder 11 is formed with a D-shaped cross section cut-out horizontally at an upper part of the plug member 13*b* so as to open above the plug member 13*b*, or is formed into a rectangular groove such as a key way. Using this type of introduction hole 13*d*, air or inert gas and so on that has trapped inside molten metal can be reliably purged from the melting cylinder 11 to the injection cylinder 21 side when initially starting operation of the injection device 1. This is because it is easy for air and gas to collect at the top. Preferably the end cap 13 is not only covered and insulated by a heat shielding member 14, but is also provided with a deep hole in its center though which a cartridge heater is fitted, and can be heated by this cartridge heater 15. In this case, since the end cap 13 is sufficiently heated, molten metal does not solidify in the introduction hole 13*c*, even in the case of magnesium alloy, which is solidified easily.

As a result of the introduction hole 13*d* opening above the plug member 13*b*, the following phenomenon is also suppressed. Namely it is an phenomenon arising when molten metal that has been melted inside the melting cylinder 11 is initially supplied to the empty injection cylinder 21, and an phenomenon of an unstable outflow, where molten metal inside the melting cylinder 11 flows suddenly in an unstable manner to the injection cylinder 21 when the backflow prevention device 30 opens the connecting passage 18*a*. By preventing this phenomenon, the occurrence of the problem that the following melting stagnates temporarily is also suppressed, since the problem occurs because the space by the decrease of the molten metal in the melting cylinder 11 becomes insulation space and heat due to the heater is not sufficiently conveyed.

It is also possible for the base end or the vicinity of the base end of the melting cylinder 11 to have pouring holes for pouring of inert gas. In FIG. 3, the pouring hole 90*c* is formed at the boundary of the melting cylinder 11 and a side plate 90*a* of the central frame member 90, but it can also be formed at the melting cylinder 11 side or the central frame member 90, as long as they are in this area. By pouring inert gas into this pouring hole 90*c*, air inside the cylinder bore 11*a* is purged and oxidization of material is prevented. This type of purging is particularly effective in a preparation stage of magnesium molding, that is, at a stage of initially inserting the magnesium material into the empty cylinder bore 11*a* and melting it.

The amount of inert gas supplied is only that supplied to the empty cylinder bore 11*a* and so is very small. Obviously, after completing a preparation stage, it is possible to stop the supply of inert gas. This is because, as will be described later, there is no invasion of air from the back into the molten metal inside the melting cylinder 11 when purging has finished.

The backflow prevention device 30 preferably has the structure of the embodiment as shown in FIG. 4. This backflow prevention device 30 comprises a valve seat 21*f* formed on a surface of an inner hole of the cylinder hole 21*a*, a rod-shaped backflow prevention valve stem 31 separating from or touching to the valve seat 21*f*, and a fluid pressure cylinder 32, such as a hydraulic cylinder, fixed to a side surface of the injection cylinder 21, which is a valve stem drive unit for driving the backflow prevention valve stem 31. The valve seat 21*f* is formed at an inlet of a through hole 21*h* connecting to the connecting passage 18*a*, and opens inside the injection cylinder 21. The backflow prevention valve stem 31 which has a base end connected to a piston rod of the hydraulic cylinder 32, is fitted into a valve stem guide hole 21*g* formed in the injection cylinder 21, and has a major portion moving inside the molten metal. The hydraulic cylinder 32 is attached to a lower side surface of the injection cylinder 21 opposite to the connecting member 18.

By having the backflow prevention device 30 with this type of structure, most of the backflow prevention valve stem 31 exists within the molten metal inside the injection cylinder 21, and the temperature of the backflow prevention valve stem 31 is hardly decreased at all. Therefore, the molten metal around the backflow prevention valve stem 31 is not solidified even if the molten metal is magnesium. This phenomenon is made more effective by making the mounting position of the connecting member 18 slightly closer to the base end than the forward end of the injection cylinder 21. This is because molten metal that exists around the backflow prevention valve stem 31 is held at a sufficiently high temperature. Naturally opening and closing of the connecting passage 18*a* by the backflow prevention valve stem 31 is accurately controlled according to the timing of metering and injection. This type of backflow prevention device 30 is therefore ideally suited to a precision injection machine that requires accurate control of injection volume.

The above describe backflow prevention device 30 is also preferably provided with a seal mechanism for the backflow prevention valve stem 31, as described in the following. This seal mechanism includes a block sleeve 33 fixed to the valve stem guide hole 21*g* formed in the injection cylinder 21, and a cooling pipe 34 for cooling this block sleeve 33, as shown in FIG. 4. The valve stem guide hole 21 g is formed larger to such an extent as to cause a 1 mm gap with respect to the backflow prevention valve stem 31, as shown in exaggerated fashion in the drawing. The block sleeve 33 guides the backflow prevention valve stem 31 so as to be capable of movement and with almost no gap, and blocks off the valve stem guide hole 21*g* by being fitted into the valve stem guide hole 21*g*. The block sleeve 33 is cooled from the outside by a cooling pipe 34 where cooling water is supplied. With this type of structure, molten metal in the vicinity of the block sleeve 33 existing in the valve stem guide hole 21*g* is solidified while remaining moderately soft around the backflow prevention valve stem 31, as described in the following.

Specifically, molten metal is not hardened to such an extent as to solidify so as to hinder movement operations of the backflow prevention valve stem 31, but is hardened to such an extent as to seal the gap between the backflow prevention valve stem 31 and the valve stem guide hole 21*g* in a suitably softened state. Accordingly, solid matter acts on a seal member, avoiding direct contact between the backflow prevention valve stem 31 and the valve stem guide hole 21, and preventing sticking of the two due to wear and thermal expansion.

A nozzle hole 22*a* from the injection cylinder 21 to the injection nozzle 22 is preferably formed so as to open at a position offset above the cylinder bore 21*a*, as shown in FIG. 5. In this case, the injection cylinder 21 can be arranged at an inclined attitude with the forward end high up and the base end low. The inclination angle does not need to be greater than about 3 degrees. With this type of structure, it is possible to reliably purge air or gas that has remained inside the injection cylinder 21, and the problem of molten metal flowing out from the injection nozzle 22 is also solved. In this case, in the melting cylinder 11, it is also preferable to form the introduction hole 13*d* of the end plug 13 above as has already been described, and to arrange the melting cylinder 11 at the same inclination of about 3 degrees. As a result of this type of arrangement, air inside the melting cylinder 11 is also similarly reliably purged and it is possible to prevent unstable outflow. Suitably in addition to the structure of the above described introduction hole 13*d* of the melting cylinder 11 and the arrangement of the nozzle hole 22*a* with the injection nozzle 22 offset, it is better if the injection device 1 is arranged at an inclined attitude with the base ends of the melting cylinder 11 and the injection cylinder 21 are lowered to about 3 degrees. It is also possible for the entire injection molding device including a clamping device to be arranged at an inclined attitude as describe above.

With the injection device 1 of the present invention, the melting device 10 and the plunger injection device 20, which are main structural components, preferably have the structure as described below. Two embodiments of the melting device will be described herein below.

As for the melting device 10 of a first embodiment, a cylinder bore 11*a* of a melting cylinder 11, except for a base end section, comprises a cylinder bore 11*b* having a diameter a few mm larger than the billet 2, and has a stepped section 11*c* formed at the base end, as shown in FIG. 3. The size of this larger diameter cylinder bore 11*b* is determined in advance in accordance with the material and size of the molded item, and in the case of a molding device for molding magnesium alloy, for example, is selected so that a gap with respect to the billet 2 is from 0.5 to 2 mm, and is preferably about 1 mm. Also, the position of the stepped section 11*c* is determined in advance and is related to the required volume of molten metal and the temperature setting of the heater 12*d*, or the gap between the larger diameter cylinder bore 11*b* and the billet 2. The heaters 12*a* to 12*d* are the same as those already described.

With this type of structure, when the billet 2 is pushed forwards at the time of metering, the tip of the already softened billet 2 is enlarged due to the pressure of the molten metal, and the side surface 2*a* comes into contact with the wall surface of the cylinder bore 11*b*. At this time, pressure for inserting the billet 2 does not become excessive because pressure inside the melting cylinder 11 at the time of metering is suppressed appropriately, as has already been described. Also, since the gap between the cylinder bore 11*b* and the billet 2 is made appropriately large, the side surface 2*a* of the billet 2 is not pressed against the cylinder bore 11*b* over a wide range or at high pressure, and only makes contact at the tip section. The side surface 2*a* contacting the larger diameter cylinder bore 11*b* continues to be heated by the high temperature molten metal and the larger diameter cylinder bore 11*b* so that the side surface 2*a* appropriately maintains the softened surface layer on it. As well as these, the fact that the gap between the inner hole of the base end of the cylinder bore 11*a* and the billet 2 is small improves concentricity of the billet 2 with respect to the melting cylinder 11, and make the contact state between the expanded diameter side surface 2*a* and the cylinder 11*a* uniform. In this way, the side surface 2*a* functions as an appropriately softened seal member for contacting the cylinder bore 11*b* uniformly, reliably preventing backward flow of molten metal to the rear and infiltration of air and so on into the molten metal, and reducing fictional resistance. The side surface 2*a* of this embodiment can therefore be termed a seal member using the expanded diameter side surface 2*a*, that is, an expanded diameter seal member.

The size of a gap between the expanded diameter cylinder bore 11*b* and the billet 2 has a particularly significant effect on the creation shape of the above described seal member formed between the cylinder bore 11*b* and the billet 2. First of all, in the case where the gap is too small, when the billet 2 is inserted, contact between the side surface 2*a* and the cylinder bore 11*b* is immediately established, then frictional resistance increases, and as a result of this increase in resistance the rear part of the billet increases further in diameter from a position where contact is established. This increased diameter of the side surface 2*a* grows more to the rear part and extreme increase in the frictional resistance finally makes advancement of the billet 2 impossible. On the other hand, when this gap is large, molten metal in the gap is not reduced in temperature or in pressure so that there occurs backward flow, and as a result molten metal infiltrates as far as the rear gap from the stepped section 11*c* and solidifies there. In this case, since the temperature in the gap at the base section of the cylinder 11 is particularly low, it is easy for molten metal to solidify rapidly, and as well as this the gap is simply straight which means that solidified material grows further at the time of metering. As a result, the enlarged solidified material causes frictional resistance between the cylinder 11 and the billet 2 to increase significantly ultimately making advancement of the billet 2 impossible. Therefore an appropriate size for the gap is selected in advance from pluralities of available sizes in accordance with the molding material and injection capacity of the injection molding machine.

With the above-described melting device 10 of the first embodiment, the structure of the melting cylinder 11 has the advantage that it is a simple structure comprising the cylinder bore 11*b* and the stepped section 11*c*. However, this type of melting device 10 is not often adopted as a melting device 10 in a large-scale injection molding machine or a high cycle rate injection molding machine. The reason for this is that with a large-scale injection molding machine, the diameter of billets is so thick and the circumference is so long that it is difficult to adjust the gap, which means that it is easy for backward flow of molten metal to arise at the time of metering. Also, with an injection molding machine that requires a fast cycle time, the metering operation must also be fast, the operation of inserting the billets is high speed and pressure of the molten metal is inevitably high, and as a result it is easy for the backward flow to arise. Therefore, the characteristics arise as a result of being adopted in an injection molding machine having comparatively small diameter billets or an injection molding machine that has a comparatively long molding cycle.

Figure 6:
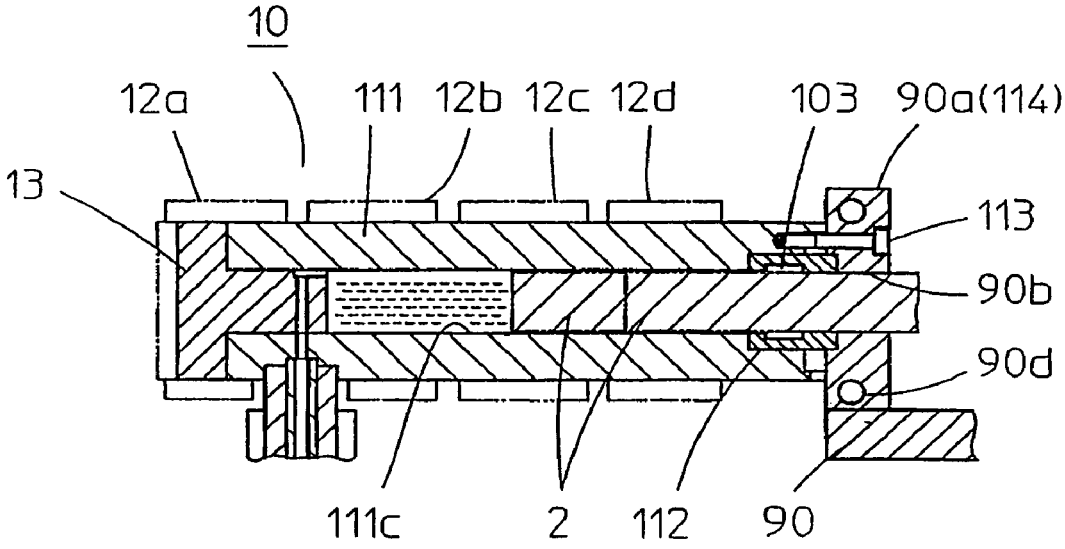
FIG. 6 is a side cross-sectional view of a further preferred melting device of another alternative embodiment of the present invention.
Figure 7:
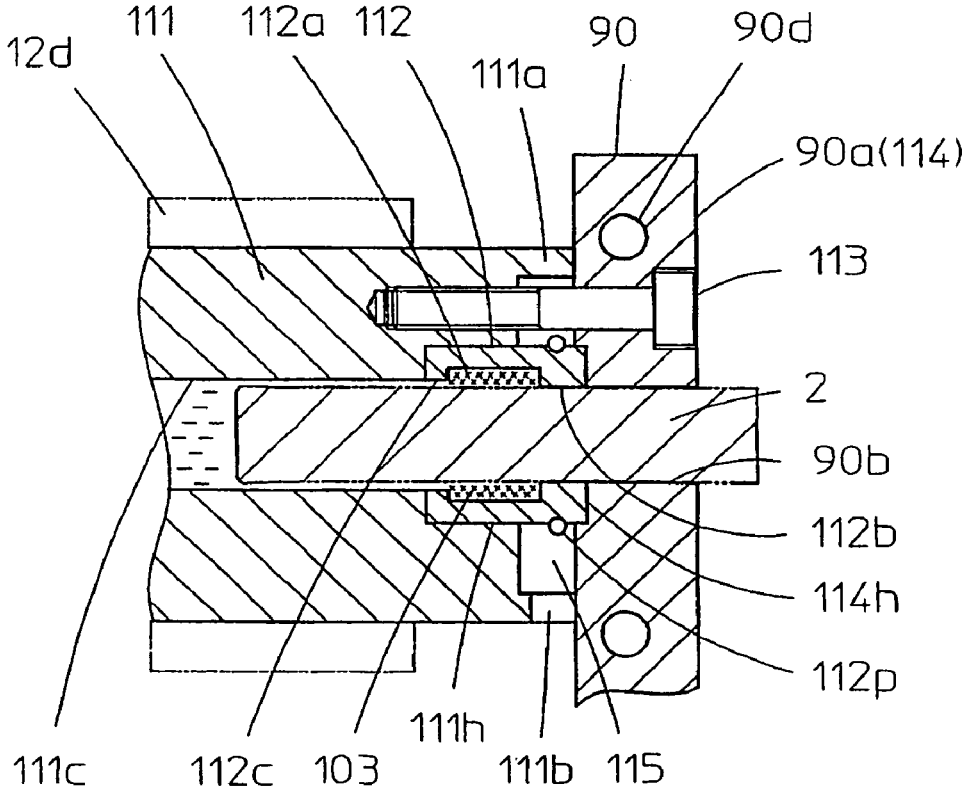
FIG. 7 is a side cross-sectional view showing an enlargement of essential parts of the melting device of FIG. 6.

On the other hand, with the melting device of a second embodiment, the melting cylinder has the structure as shown in FIG. 6 and FIG. 7. FIG. 6 is a cross sectional drawing showing the schematic structure of this melting device, and FIG. 7 is a cross sectional drawing showing main parts of the melting device. Structural elements in the drawing that have already been described have the same reference numerals, and description thereof is omitted.

In addition to the central frame member 90, billet supply device 40 and billet inserting device 50 already described, this melting device 10 comprises a melting cylinder 111 fixed to the side plate 90*a* of the central frame member 90, and a cooling sleeve 112 fitted between this cylinder 111 and the side plate 90*a*. The central frame member 90 is the same as the central frame member already described, and also has through holes 90*b* in two opposed side plates 90*a*, but in particular a cooling duct 90*d* in which cooling fluid is supplied with and circulating is formed in the periphery of a melting cylinder 111 side of the through hole 90*b*. Therefore side plates 90*a* cools the billets 2 positioned at the base end side so as to be slightly soft to such an extent that they are not deformed by insertion pressure at the time of metering. Also, in the case of magnesium alloy molding, for example, the through hole 90*b* is formed to a size that creates a gap of from 0.2 to 0.5 mm with respect to the billet 2. Because of this gap, the billets 2 are inserted in a state where there is hardly any gap between the melting cylinder 111 when softened and raised in temperature as has already been described. This side plate 90*a* is also called cooling members 114 in the following.

The melting cylinder 111 has the same structure as the already described melting cylinder 11, apart from the shape of the base end side, and is formed into a cylinder of such a length that molten metal corresponding to the injection volume of pluralities of shots is temporarily retained. The heaters 12*a*, 12*b*, 12*c* and 12*d* are similarly wrapped in order from the forward side to the base end side. In particular, with this embodiment the heaters 12*a* to 12*c* are set to equal to or greater than the melting temperature of the billets 2, while the heater 12*d* is appropriately adjusted to a temperature that is lower than the melting temperature of the billets 2. For example, when the billets 2 are magnesium alloy, the heaters 12*a* to 12*c* are set to about 650° C., and the temperature of the heater 12*d* is appropriately adjusted to about 550° C. Therefore the billets 2 changes into molten metal in temperature from 600° C. to 650° C. while the billets 2 move inside the cylinder bore 111*c* towards the front. The heater 12*d* is attached at a position that avoids the vicinity of the base end of the melting cylinder 111 fitted with the cooling sleeve 112, and is configured so that the cooling sleeve 112 is not heated.

As shown in FIG. 7, this type of melting cylinder 111 has an annular protrusion 111*a* of the shape of the sleeve on the outer side of the base end and has an insertion hole 111*h* into which the cooling sleeve 112 is fitted at the inner side. On the other hand, the cooling sleeve 112, which will be described in detail in the following, is set between the base end of the melting cylinder 111 and a front surface of the side plate 90*a* acting as a cooling member 114, and is formed as a substantially cylindrical member having a small surface area so that contact surface area between the two is as small as possible. Therefore, when the melting cylinder 111 is fitted to the side plate 90*a*, namely to the cooling member 114, intervened by the cooling sleeve 112 using a bolt 113, a space 1.15 is formed between the melting cylinder 111, the cooling member 114, the annular protrusion 111*a* and the cooling member 114. Heat confined in this space 115 is then dissipated from pluralities of holes or cut-outs 111*b* formed in the annular protrusion 111*a*. This space 115 therefore functions as a heat insulating space 115 between the cooling member 114 and the melting cylinder 111.

As shown in FIG. 7, the cooling sleeve 112 is fitted between an insertion hole 114*h* in the front surface of the cooling member 114 and an insertion hole 111*h* at the base end of the melting cylinder 111. A temperature sensor, not shown, is then attached to the cooling sleeve 112 and the temperature of the cooling sleeve 112 is detected. Also, an annular groove 112*a* is formed in an inner hole of the cooling sleeve 112 where molten metal flown backwards along the periphery of the billet 2 is solidified and becomes matter 103 in a solidified state softened to an extent. More specifically, when the billets 2 are magnesium alloy, for example, this annular groove 112*a* has a groove width of from 20 mm to 40 mm, preferably 30 mm, and the groove depth is formed to from 3 mm to 4 mm with respect to the cylinder hole 111*c* of the melting cylinder 111.

In FIG. 6, the annular groove 112*a* is formed completely inside the cooling sleeve 112, but it is also possible to form the annular groove 112*a* in a hole processed from the one end so as to contact either the melting cylinder 111 side or the cooling member 114 side. The cooling sleeve 112 having this type of annular groove 112*a* is directly cooled by coming into contact with the cooling member 114, whereas is hardly heated by the heater 12*d*. Therefore the cooling member 114 mainly cools the cooling sleeve 112 and the annular groove 112*a* is powerfully cooled. Furthermore in addition to cooling from the cooling member 114, it is also possible to directly cool the cooling sleeve 112 itself. In this case, a cooling pipe 112*p* is wrapped around the outside of the cooling sleeve 112 to cool it.

With this type of structure, the billet 2 positioned inside the cooling member 114 and the cooling sleeve 112 is strongly cooled and there is no excessive softening due to high temperature conveyed from the melting cylinder 111. For example, with a magnesium molding machine the temperature of a deep part of a billet 2 positioned inside the cooling member 114 is cooled so as not to exceed 100 to 150° C., and the temperature of the deep part of the billet 2 positioned inside the cooling sleeve 112 is controlled to be 250 to 300° C. which is below 350° C. at which softening occurs.

In addition to the above described structure, the inner diameter of an inner hole 112*b* of the base end side of the cooling sleeve 112 (the cooling member 114 side) is the same as the through hole 90*b* of the cooling member 114, and is formed to a size that enables a minute gap with respect to the billet 2 so that there is no interference with a billet 2 that has thermally expanded to a certain extent. Specifically, in the case where the billet 2 is magnesium alloy, this gap is formed to from 0.2 mm to 0.5 mm. With this type of structure, since the billet is held at a central position inside the through hole 90*b* and the inner hole 112*b* of the cooling sleeve 112 with almost no gap, a gap between the billet 2 and the inner hole 112*c* of the melting cylinder 111 and a gap between the billet 2 and the annular groove 112*a* are made uniform with hardly any deviation.

Also, the cylinder bore 111*c* of the melting cylinder 111 and the inner hole at the melting cylinder 111 side of the cooling sleeve 112 are formed a few mm larger than the inner hole 112*b* at the base end side of the cooling sleeve 112. For example, in the case where the molding material is magnesium alloy, the inner diameter of the cylinder bore 111*c* and the inner hole 112*c* are from 1 mm to 3 mm larger at the radius size than the size of the inner hole 112*b*. This means that a gap between the cylinder bore 111*c* and the billet 2 and a gap between the inner hole 112*a* and the billet 2 are also from 1 mm to 3 mm. The operational effect of this gap will be described later.

The cooling sleeve 112 is not obstructed in stiffness, regardless of the structure of a small volume member as illustrated, namely a comparatively thin cylindrical member. This is because since solidified material 103, which will be described later, is formed in the annular groove 112*a*, infiltration of molten metal from this solidified material 103 to the rear is prevented. This is also due to the fact that even if there is temporary infiltration of molten metal, the pressure of that molten metal is much lower than the pressure of molten metal inside the cylinder bore 111*c*. The material for the cooling sleeve 112 is selected to conform in rigidity and thermal expansion with that of the melting cylinder 111 and the cooling member 114 and has as good a thermal conductivity as possible.

With the melting device 10 of the second embodiment, when operation initially commences, the billet 2 advances at low speed. Then molten metal already melted at the forward end of the melting cylinder 111 flows backwards along the billet 2 and fills up the annular groove 112*a*, and immediately changes to solidified matter 103. This solidified matter 103 achieves the effect of sealing since the molten metal itself solidifies in a softened state to the extent at the periphery of the billet 2 as will be described next, and for that reason is also called a self-sealing member 103 in the following.

Specifically, this self-sealing member 103 is solidified matter produced from molten metal at the periphery of the billet 2 at the position of the annular groove 112*a*, and so even in the case where a slight offset of the billet 2 exists with respect to the melting cylinder 111, the periphery of the billet is buried with no gaps. Also, since a part at the outer side of the self-sealing member 103, namely the annular groove 112*a* side, is adequately solidified and fitted into the annular groove 112*a*, the self-sealing member 103 is not subject to crush damage due to advancement of the billet 2 and the pressure of molten metal at the time of metering. In this regard, the pressure at the time of metering is not as high as the pressure at the time of injection. There is therefore absolutely no occurrence of the phenomenon where the self-sealing member 103 grows at the time of metering. Also, bonding strength of the self-sealing member 103 and the billet 2 does not become so strong because contact surfaces of the two are renewed at every time of metering accompanying temperature drop. This is because a billet 2 which advances and is renewed at every time of metering advances from the rear low temperature region and is at a lower temperature than the self-sealing member 103 at the beginning of metering. The advanced billet 2 is heated from the forward end until the next metering and the temperature of the contact surface of the self-sealing member 103 is heated up again to a suitable softening temperature.

In this way, when the billet 2 advances and pushes the molten metal at the time of metering, the self-sealing member 103 naturally prevents backward flow of molten metal by blocking a gap between the billet 2 and the melting cylinder 111, and allows no infiltration of air and so on. The self-sealing member 103 also reduces frictional resistance at the time of moving the billet 2. The sealing action of this type of self-sealing member 103 becomes most effective by utilizing characteristics of rapidly changing state from a solid to a fluid as a result of large coefficient of thermal conductivity, small thermal capacity and latent heat, which are characteristic of light metal material, especially magnesium alloy. In addition, when sealing using the self-sealing member 103 is carrying out, an operational effect where metering is stable without variation is also achieved. This is because since a gap between the inner diameter of the cylinder bore 111*c* of the melting cylinder 111 and the outer diameter of the billet 2 is formed to a few mm, even when the tip of a billet 2 that has been softened expands in diameter slightly, the tip does not interfere with the cylinder bore 111*c*, and as a result when the billet 2 advances, molten metal reliably flows around the expanded diameter billet 2 and the room into which the molten metal does not flow does not appear, with the ultimate effect that molten metal of a volume corresponding to the billet 2 that has infiltrated into the molten metal is pushed aside and molten metal is accurately metered.

The melting device 10 of the second embodiment described above reliably seals molten metal in the melting cylinder 111 using the self-sealing member 103, which means that it can be suitably adopted in a large scale injection molding machine in which the billet 2 diameter is thicker and injection volume is large, or in an injection molding machine having a higher molding cycle. Furthermore, it is also possible to suitably adopt this melting device in a small scale injection molding machine or in an injection molding machine with a long molding cycle. Also, since there is no variation in metered volume, this injection device is preferable for precision molding.

Figure 8:
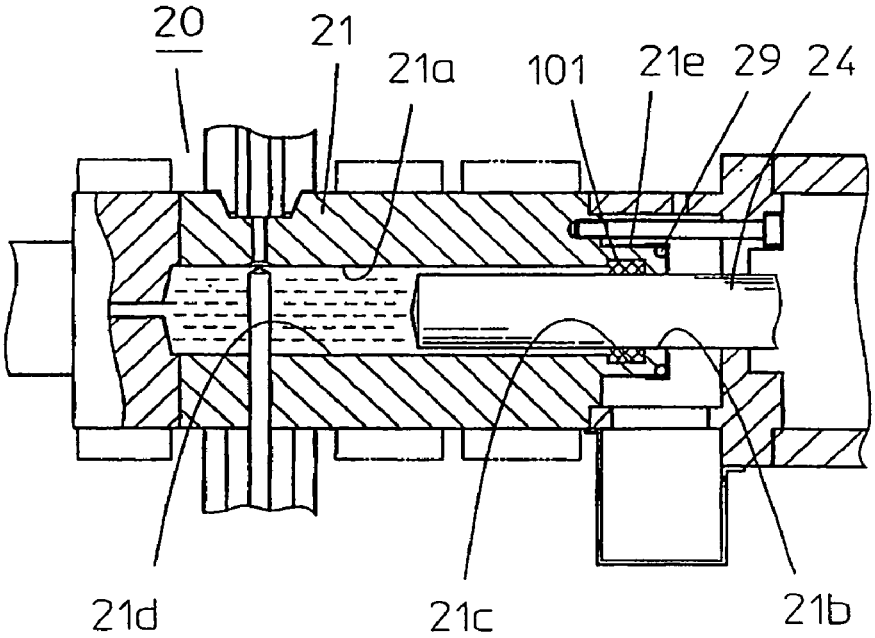
FIG. 8 is a side elevation showing a cross-sectional view of another embodiment of a plunger injection device that is a combination of an injection cylinder and a plunger, of the present invention.
Figure 9:
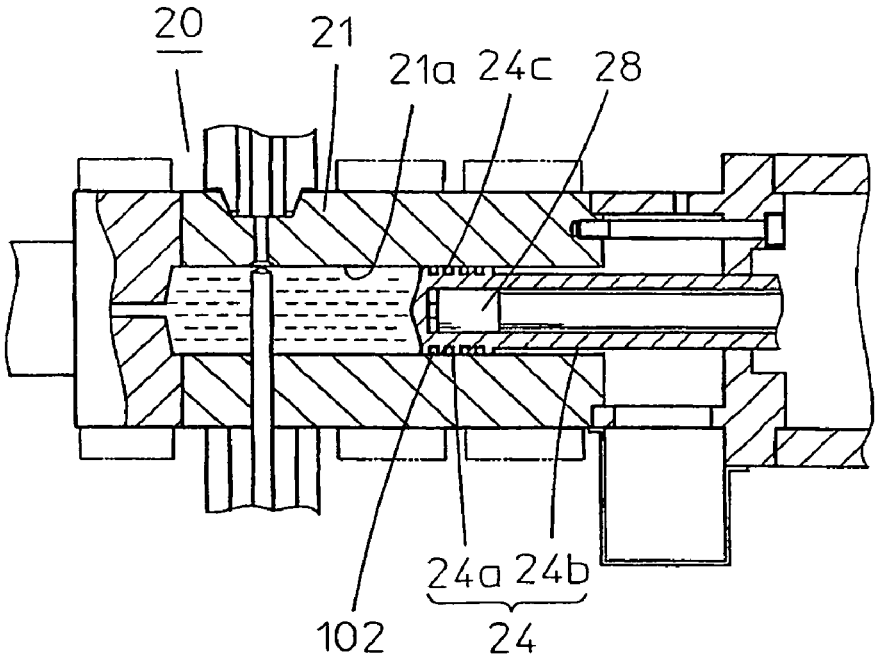
FIG. 9 is a side elevation showing a cross-sectional view of an alternative embodiment of the present invention.

In the injection device 10, the plunger 24 and the injection cylinder 21 are preferably constructed in one of the two embodiments described in FIG. 8 and FIG. 9.

With the embodiment shown in FIG. 8, most of the plunger 24 is formed as a simple cylindrical rod having a uniform size and the injection cylinder 21 is provided with a small diameter protrusion 21*e* that is directly cooled by cooling means 29 at a base end. The cooling means 29 is a cooling pipe in which coolant circulates. An inner hole at a base end side (rear end side) of the small diameter protrusion 21*e* acts as the cylinder bore 21*b* and is formed to an inner diameter such that there is almost no gap with the outer diameter of the plunger 24. A cylinder bore occupying most of the cylinder bore 21*a* and ahead of the cylinder bore 21*b* acts as a larger diameter cylinder bore 21*d* and has an inner diameter that is a few mm larger than the outer diameter of the plunger. Further, an annular groove 21*c* is formed contacting the cylinder bore 21*b* of the base end side of the small diameter protrusion 21*e*. Specifically, the cylinder bore 21*d*, in the case of an injection device for magnesium alloy, is formed large enough to allow a gap of about 1 to 3 mm with respect to the plunger 24. Also, the annular groove 21*c* has a groove width of 20 to 40 mm, preferably 30 mm, and a groove depth of 2 to 4 mm with respect to the cylinder bore 21*d*.

With this type of structure, the small diameter protrusion 21*e* of the base end of the injection cylinder 21 is cooled by the cooling means 29, and the annular groove 21*c* formed internally is particularly cooled. Therefore molten metal filled in the annular groove 21*c* when the plunger 24 initially advances, solidifies inside the groove to become solidified matter 101 quickly, and the solidified matter 101 fills up a gap between the plunger 24 and the injection cylinder 21. This solidified matter 101 functions in the same way as the sealing member already described. First, a surface of the solidified matter 101 contacting the plunger 24 is still in a state where it is suitably softened due to intense heat from the plunger 24 contacting the high temperature molten metal. Second, the solidified matter 101 contacts the plunger 24 that is finished sufficiently smooth. Third, the solidified matter 101 inside the annular groove 21*c* is not crushed or moved. The solidified matter 101 therefore constitutes a low frictional resistance seal member between the plunger 24 and the injection cylinder 21 when the plunger 24 advances at high speed at the time of injection. At this time, since there is no direct contact between the plunger 24 and the injection cylinder 21 and there is contact via the soft solidified matter 101, frictional resistance between the two is reduced. Naturally, molten metal existing in the few mm gap between the large diameter cylinder bore 21*d* and the plunger 24 is not solidified and impregnates the gap. In this manner, the above described solidified matter 101 functions as a seal member.

Next, another embodiment is shown in FIG. 9. With this embodiment, the plunger 24 is provided with a head section 24*a* that has a slightly smaller diameter than the inner diameter of the injection cylinder 21 and a shaft section 24*b* having a slightly smaller diameter than the head section 24*a*, with pluralities of annular grooves 24*c* being formed in the head section 24*a*. In the center of head section 24*a* and the shaft section 24*b* a cooling means 28 is inserted, which mainly makes contact with a peripheral surface of an inner bore of the head section 24*a* to selectively cool the annular grooves 24*c*. That is, a front end of the cooling means 28 is constructed so as to contact the plunger 24 via a heat insulating member or with the minimum surface area so as not to lower the temperature of the tip of the plunger 24 as much as possible. To this end, a cooling duct for direct cooling by circulation of coolant at an inner part, or a copper bar or pipe for indirect cooling by being cooled from the outside, is adopted for the cooling means 28. The latter is a so-called cooling heat pipe. With this embodiment, the injection cylinder 21 is constructed in a simple shape provided with a straight cylinder bore 21*a* spanning the entire length.

With this type of structure, molten metal that has initially flowed backwards along the outer periphery of the head section 24*a* enters the annular grooves 24*c* and rapidly solidifies, creating annular solidified matter 102 around the head. This solidified matter 102 is created by rapid solidification at the head 24*a* that is being cooled, but the outer periphery contacting the injection cylinder 21 is in a softened state to a certain extent due to heat from the inner hole wall surface of the injection cylinder 21 that is at a high temperature. Also, the cylinder surface of the injection cylinder 21 contacting the solidified matter 102 is subjected to finishing processing to be made suitably smooth. Therefore similarly to the seal member already described, at the time of injection, the solidified matter 102 prevents leakage of molten metal from the head 24*a* to the rear, and reduces frictional resistance generated between the head 24*a* and the injection cylinder 21. Besides this, since a gap between the plunger head 24*a* and the injection cylinder 21 is made large and direct contact between them is avoided, there is no wear between the plunger 24 and the injection cylinder 21. According to this embodiment, softening of the plunger 24 does not arise, which means that there is absolutely no manifestation of the already described phenomenon where the billet 2 increases in diameter due to softening in the melting cylinder 11. Therefore, the above-described solidified matter 102 also functions as a seal member.

According to the injection device 1 of the present invention constructed as described above, the following molding operations are carried out. For convenience of description, the actual injection molding operation will be described first. Before commencing this molding operation, pluralities of billets 2 are supplied to the melting cylinder 11 in advance, and molten metal equivalent to the injection volume of pluralities of shots is secured in the front of the melting cylinder 11. In this state, first of all, metering is carried out. To do this, the backflow prevention valve rod 31 opens the connecting passage 18*a* and at the same time the shaft 52*a* advances, the plunger 24 moves backwards, and molten metal is transferred to the injection cylinder 21. This metering step is normally carried out during a cooling step for a molded item filled in the previous molding cycle. As a result of this metering, molten metal equivalent to injection volume for one shot is reserved inside the injection cylinder 21. At this time, the advancement operation of the pusher 52*a* and the reverse operation of the plunger 24 are substantially coincident, and the pressures of molten metal inside the melting cylinder 11 and inside the injection cylinder 21 are controlled so as to maintain a specified pressure, which means that pressure at which the pusher 52*a* presses the molten metal via billet 2 does not become a particularly high pressure. Therefore, backward flow of molten metal inside the melting cylinder 11 is reliably prevented by a side surface 2*a* of the tip of a billet 2 expanded in diameter, namely the expanded diameter seal member already described, or by the self-sealing member 103 which is solidified matter produced from molten metal.

Molten metal supplied into the injection cylinder 21 by the metering is maintained in a molten state by the heater 27. Next, the backflow prevention valve rod 31 closes the connecting passage 18*a*, and then the plunger 24 advances to inject molten metal for one shot into a mold from the injection nozzle 22. At this time, as already described, solidified matter 101 or 102 prevents backward flow of molten metal as a seal member. Next, pressure maintaining process known in the related art is carried out, then a cooling step is entered, and the above described metering starts again. Molten metal in the melting cylinder 11 consumed by the metering process is replenished by being melted until the following metering starts after proceeding metering.

After injection for a single billet is carried out by melting the billet at the time of metering, replenishing with a new billet 2 is carried out. This replenishing operation starts after a position detector for the pusher 52*a* detects that the pusher 52*a* has advanced to reach a distance of one billet during metering. Initially, the billet inserting device 50 causes the pusher to move a distance greater than the entire length of the billet 2 to ensure a space for supplying the billet 2 behind the melting cylinder 11. Next, the billet supply device 40 supplies one billet 2 to the rear of the melting cylinder 11 and finally the billet inserting device 50 pushes that billet 2 into the melting cylinder 11. At this time, the end surface of the billet 2 is machined smooth, and a gap between the melting cylinder 11 and the billet 2 is formed to be slight, which means that there is almost no air and so on entering the gap between the two. This replenishing operation is carried out during a cooling period for the molded item. Accordingly, the replenishing operation does not cause any delay in the molding cycle.

The following describes preparations which take place before the actual molding operation is carried out. Initially, preferably an inert gas is injected to purge the air in the cylinder. Next, billets 2 loaded into the hopper 41 in advance are supplied to the rear of the melting cylinder 11 by the billet supply device 40, and inserted into the melting cylinder 11 by the billet inserting device 50. Pluralities of billets 2 are inserted so that the melting cylinder 11 is full of billets. At this time, the backflow prevention valve rod 31 closes the connecting passage 18*a*.

Plurality of billets 2 are heated by the heaters 12*a*, 12*b*, 12*c* and 12*d* in a state of being pressed forward in the melting cylinder 11, and start to melt at the tip from a part positioned at the forward side. Most of the air accumulated at the forward side of the melting cylinder 11 is squeezed out to the rear along with the molten metal being filled. After molten metal for pluralities of shots is ensured, the backflow prevention valve rod 31 opens the connecting passage 18*a*, and the plunger 24 retreats together with continued advancement of the pusher 52*a*, and molten metal is fed to the injection cylinder 21. Air or inert gas that has accumulated inside the molten metal and has not been squeezed out is then purged together with the molten metal. In particular, in the case where the introduction hole 13*d* of the end plug 13 is formed so as to open above the melting cylinder bore 11*a*, this purging in the melting cylinder 11 can be carried out rapidly.

Next, after the molten metal is filled into the injection cylinder 21, purging operations corresponding to the injection already described are similarly carried out. This purging is carried out particularly quickly in the case where the nozzle hole 22*a* of the injection nozzle 22 opens above the injection cylinder bore 21*a*. Once purging is completed, the injection nozzle 22 comes into contact with the mold, and the preparatory molding operations are performed. Molding conditions are then adjusted and once stable, preparatory operations before molding are complete.

The invention described above is not limited to the above-described embodiments, and various modifications are possible based on the gist of the invention, and these modifications do not depart from the scope of the attached claims. In particular, with respect to specific devices, basic functions complying with the gist of the invention are included in this present invention.

What is claimed is:

1. An injection device for a light metal injection molding machine comprising:

a melting device for melting light metal material into molten metal, said light metal material supplied in the form of cylindrical rod-shaped billets equivalent to a shot volume of a plurality of shots, said melting device including:

a melting cylinder, the melting cylinder having a length capable of holding a plurality of billets, the melting cylinder wrapped around by a plurality of heaters, forward heaters for being set to a melting temperature and at least a base end heater for being set to a low temperature, the melting cylinder for heating and melting the plurality of billets supplied from a rear end of the melting cylinder to generate molten metal equivalent to a volume of a plurality of shots at a front side, the plurality of billets for being subjected to preliminary heating at a base end of the melting cylinder in a state where softening is prevented, and said plurality of billets for being strongly heated while passing from a middle part of the melting cylinder to a forward end of the melting cylinder to rapidly melt at the forward end;

a billet supply device positioned at a rear end of the melting cylinder for supplying the plurality of billets one at a time, at the time of material supply, in such a manner that the plurality of billets are inserted from the rear end of the melting cylinder, and a billet inserting device positioned behind the billet supply device, said billet inserting device containing a pusher, the pusher for forcing molten metal for one shot volume into an injection cylinder using a billet when metering, or said pusher for inserting a billet into the melting cylinder using a billet at the time of material supply;

a plunger injection device for carrying out injection of molten metal using a plunger after molten metal is metered into the injection cylinder from the melting device;

a connecting member including a connecting passage for connecting the melting device and the plunger injection device;

a backflow prevention device for preventing backflow of molten metal by opening and closing the connecting passage;

most of a cylinder bore, except for a base end of the melting cylinder, provided with a dimensional relationship for causing a gap with a side surface of a tip of a softened billet;

a cooling member at a base end of the melting cylinder, the cooling member for cooling a base end of a billet to such an extent that there is no deformation due to pressing force at the time of metering; and a cooling sleeve, being of a small volume member, being peripherally exposed to a space between a rear end of the melting cylinder and the cooling member, and being positioned between the melting cylinder and the cooling member, the cooling sleeve for cooling molten metal, the cooling sleeve having an annular groove for forming a seal member of a solid material around a billet, the seal member solidified from molten metal to such an extent as to prevent backward flow of molten metal.

2. The injection device for a light metal injection molding machine according to claim 1, wherein most of the plunger is formed in a simple cylindrical shape, and wherein the injection device further comprises:

a small diameter projecting section provided on a base end of the injection cylinder, controlled to a lower temperature than the injection cylinder;

an inner hole at a base end of the small diameter projection section, the inner hole having an inner diameter such that there is almost no gap formed with the plunger;

a second annular groove in the inner hole of the small diameter projecting section; and most of a cylinder bore, except for a base end of the injection cylinder, including an inner diameter having a gap with respect to the plunger, wherein a solidified seal member of the molten metal is for being generated in the second annular groove to an extent that prevents backward flow of the molten metal.

3. An injection device for a light metal injection molding machine comprising:

a melting device for melting light metal material into molten metal, said light metal material supplied in the form of cylindrical rod-shaped billets equivalent to a shot volume of a plurality of shots, said melting device including:

a melting cylinder for heating and melting a plurality of billets supplied from a rear end of the melting cylinder to generate molten metal equivalent to a volume of a plurality of shots at a front side, the plurality of billets for being subjected to preliminary heating at a base end of the melting cylinder in a state where softening is prevented, and said plurality of billets for being strongly heated while passing from a middle part of the melting cylinder to a forward end of the melting cylinder to rapidly melt at the forward end;

a billet supply device positioned at a rear end of the melting cylinder for supplying the plurality of billets one at a time, at the time of material supply, in such a manner that the plurality of billets are inserted from the rear end of the melting cylinder, and a billet inserting device positioned behind the billet supply device, said billet inserting device containing a pusher, the pusher for forcing molten metal for one shot volume into an injection cylinder using a billet when metering, or said pusher for inserting a billet into the melting cylinder using a billet at the time of material supply;

a plunger injection device for carrying out injection of molten metal using a plunger after molten metal is metered into the injection cylinder from the melting device;

a connecting member including a connecting passage for connecting the melting device and the plunger injection device;

a backflow prevention device for preventing backflow of molten metal by opening and closing the connecting passage;

most of a cylinder bore, except for a base end of the melting cylinder, provided with a dimensional relationship for causing a gap with a side surface of a tip of a softened billet;

a cooling member at a base end of the melting cylinder, the cooling member for cooling a base end of a billet to such an extent that there is no deformation due to pressing force at the time of metering; and a cooling sleeve, being of a small volume member, being positioned between the melting cylinder and the cooling member, the cooling sleeve for cooling molten metal, the cooling sleeve having an annular groove for forming a seal member of a solid material around a billet, the seal member solidified from molten metal to such an extent as to prevent backward flow of molten metal.

* * * * *

UNITED STATES PATENT AND TRADEMARK OFFICE

CERTIFICATE OF CORRECTION

PATENT NO. : 7,066,236 B2
APPLICATION NO. : 10/947263
DATED : June 27, 2006
INVENTOR(S) : Misao Fujikawa It is certified that error appears in the above-identified patent and that said Letters Patent is hereby corrected as shown below:

On the Title page, insert.

(22) PCT Filed: July 22, 2003

(86) PCT No.: PCT/JP03/09263

(30) Foreign Application Priority Data

Sept. 24, 2002 (JP).....2002276607
July 23, 2002 (JP).....2002213388

Signed and Sealed this

Twenty-sixth Day of June, 2007

JON W. DUDAS
*Director of the United States Patent and Trademark Office*